United States Patent [19]

Schlough

[11] 4,196,835

[45] Apr. 8, 1980

[54] STITCHING MACHINE

[75] Inventor: James R. Schlough, Easton, Pa.

[73] Assignee: Harris Corporation, Melbourne, Fla.

[21] Appl. No.: 13,326

[22] Filed: Feb. 21, 1979

[51] Int. Cl.[2] ..... B27F 7/10; B42B 1/12

[52] U.S. Cl. ..... 227/81; 11/1 R; 227/99

[58] Field of Search ..... 11/1 R; 227/81, 82, 227/99

[56] References Cited

U.S. PATENT DOCUMENTS

| | | | |
|---|---|---|---|
| Re. 13,967 | 8/1915 | Juengst | 227/84 |
| 1,252,011 | 1/1918 | Maynard | 227/84 |
| 1,302,402 | 4/1919 | Maynard | 227/88 |
| 1,534,141 | 4/1925 | Roesen | 227/81 |
| 1,608,838 | 11/1926 | Christensen | 227/81 |
| 1,983,384 | 12/1934 | McClure | 227/90 |
| 2,827,632 | 3/1958 | Faeber | 227/81 |
| 3,275,210 | 9/1966 | McCain et al. | 227/82 |
| 3,514,027 | 5/1970 | Linden | 227/81 |
| 3,892,427 | 7/1975 | Kraynak et al. | 11/1 R |

*Primary Examiner*—John McQuade

[57] ABSTRACT

A collating machine is disclosed in which a reciprocating frame carries a conventional stitcher head and clincher assembly to bind groups of signatures on the fly. A stitcher assembly includes cams and linkages to drive the stitcher head and clincher as the frame reciprocates. Two suspension units guide the reciprocating frame along a substantially linear path. Each suspension unit includes two suspension links and a coupling link. The upper ends of the suspension links are pivotally mounted to the base of the stitcher assembly, and the axes of rotation lie in a horizontal plane. The lower end portions of the suspension links in each suspension unit are pivotally connected with opposite ends of the base of the coupling link. This arrangement enables the coupling link to rock about a central position in which the base of the coupling link includes a pedestal which extends upward from the base of the coupling link and to which the reciprocating frame is connected. The top of the pedestal travels along a substantially straight line path as the coupling link rocks about its central position.

16 Claims, 4 Drawing Figures

STITCHING MACHINE

BACKGROUND AND SUMMARY OF THE INVENTION

The present invention relates to an improved apparatus for stitching or stapling a group of collated signatures to form a book or magazine.

Prior to the present invention collated groups of signatures have been conveyed through a stitcher assembly which stapled together collated groups of signatures. The stitcher assembly includes a conventional stitcher head disposed above the path of movement of the signatures and a conventional clincher disposed below the path of movement of the signatures. The stitcher head bends a short piece of wire to form a staple and drives it through the collated signatures, and the clincher folds the ends of the staple to finish the stitching operation. Examples of known stitcher heads and clinchers can be found in U.S. Pat. Nos. 1,252,011; 1,302,402; 1,983,384; and 3,514,027.

It has been a practice to mount stitcher assemblies on a frame which is driven in a reciprocating motion parallel to the path of the conveyor. As groups of collated signatures move downstream through the stitching machine, the frame and the stitcher assembly mounted on it move together with each group of signatures as the stitching operation is performed. The stitching occurs in effect "on the fly", i.e., while the group of signatures is moving. The stapled signatures leave the machine while the reciprocating frame returns upstream before stitching the next group of signatures.

The reciprocating motion of the frame has commonly been accomplished by use of a crank and connecting rod. The crank has been driven in synchronism with the conveyor, and the connecting rod is connected between a crank pin and the reciprocating frame. Cams and cam followers have also been used to drive the frame in a reciprocating motion and to actuate the stitcher head and clincher. Examples of such mechanisms may be found in the above mentioned U.S. Pat. No. 3,514,027; and in U.S. Pat. Nos. Re 13,967; 2,827,632; 1,608,838; and 1,534,141.

Further, it has been a conventional practice to mount the reciprocating frame on ways or rails which guide the frame for linear motion. Various types of ways or rails have been used, including slots or grooves formed in a fixed member which extends parallel to the path of the signature conveyor. The patents mentioned above in connection with mechanisms for driving a reciprocating frame also disclose various types of guides for supporting the frame.

The use of these means for guiding the reciprocating frame has presented various difficulties. The ways or rails are exposed and may collect dirt and grit which cause excessive wear. Use of rails results in relatively large amounts of friction so that a correspondingly large amount of power is required to reciprocate the frame. In addition, difficulties have been encountered in fabricating rails which are parallel and in maintaining parallelism over a large number of operating cycles.

The present invention provides a new and improved collating machine in which a stitcher assembly is mounted to a reciprocating frame. The reciprocating frame is guided for substantially linear motion by two suspension units. The suspension units are mounted in tandem to the base of the collating machine. The suspension units eliminate the guides or slides of conventional collating machines, and thus overcome the difficulties inherent in those systems and mentioned above.

Each suspension unit includes two suspension links and coupler link. In each suspension unit the upper ends of the suspension links are pivotably connected with the collating machine's base and the lower ends are pivotably connected with opposite ends of the base of the coupler link. The suspension links support the coupler links for rocking motion about a central position in which the bases of the coupler links are substantially horizontal.

Each coupler link includes an upstanding pedestal to which the reciprocating frame is connected. The pedestal is fixedly connected to the base of the coupler link and extends upwardly from the base midway between the connections between the base and the lower ends of the suspension links. The upper end portion of the pedestal is a pivotable connected with the reciprocating frame. It is a characteristic of the suspension units that when the coupler link rocks about its central position, the upper end portion of the pedestal travels along a substantially straight line.

BRIEF DESCRIPTION OF THE DRAWINGS

The above and other features of the present invention will become more clear to those skilled in the art to which it pertains upon reading the following description of a preferred embodiment of the invention and referring to the following figures in which.

DESCRIPTION OF A PREFERRED EMBODIMENT

Figure 1:
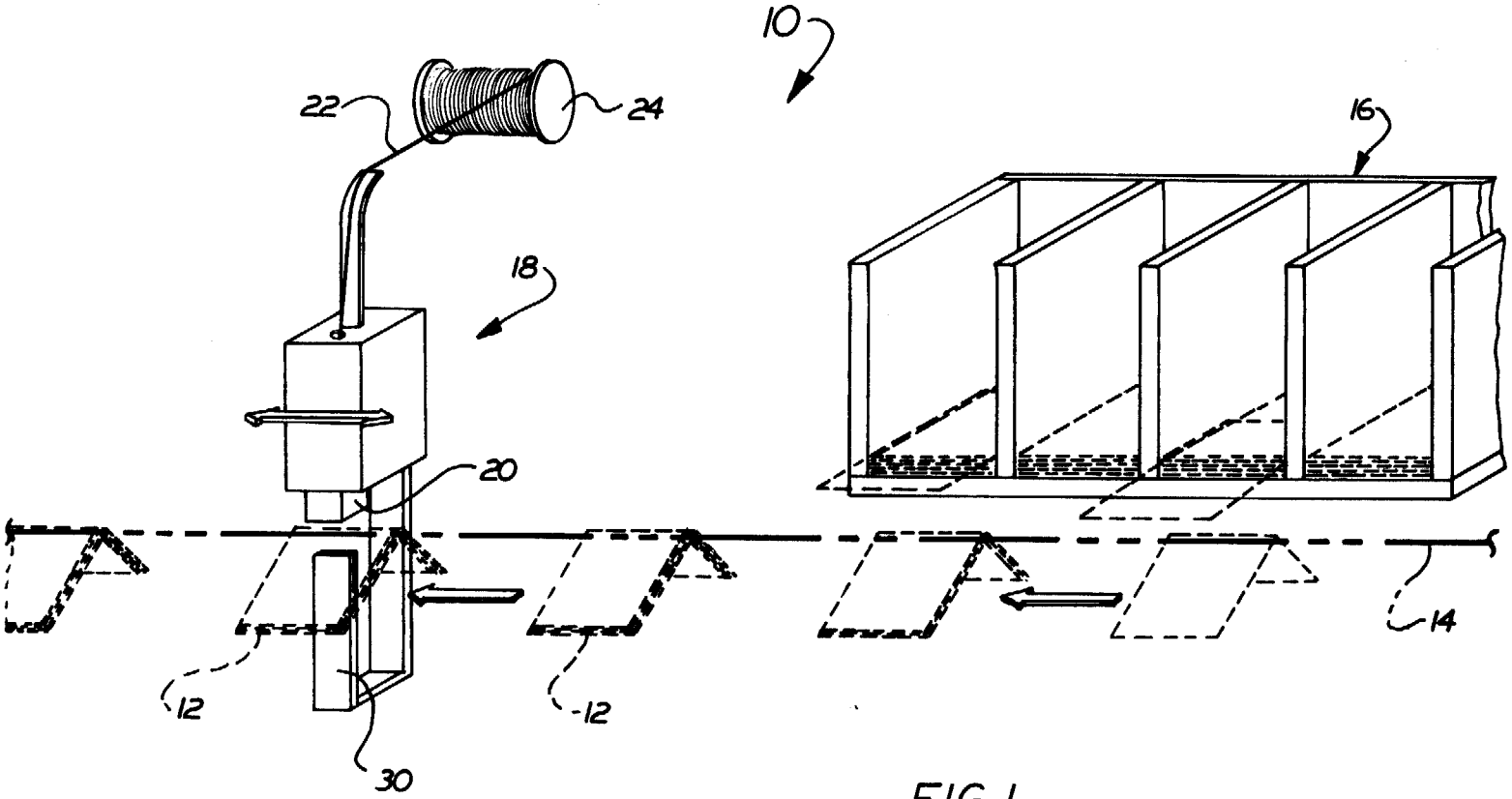
FIG. 1 is a schematic illustration of a collating machine and a signature conveyor carrying collated groups of signatures through a stitcher assembly.

As noted above, the present invention relates to an improved collating machine which includes a stitcher assembly which stitches a group of signatures while they are moving. Specifically, the stitching assembly does not require the use of rails for guiding any reciprocating mechanisms. As representative of a preferred embodiment of the present invention, a collating machine is shown in FIG. 1 and generally designated 10.

The collating machine 10 stitches groups of signatures 12. A saddle conveyor shown schematically at 14 travels past a collating station 16, and individual signatures are fed from the collating station onto the conveyor to form the group 12 of collated signatures. The conveyor 14 carries the group 12 of collated signatures through the stitcher assembly 18 which binds the signatures in each group together. Thereafter the stitched groups of signatures 12 are conveyed to a delivery station (not shown) where they are removed from the saddle conveyor for further processing.

The stitcher assembly 18 includes a conventional stitcher head 20 which drives a staple through the group 12 of signatures. The stitcher head 20 receives wire 22 from a spool 24 which it cuts to length and bends it twice to form a staple. Thereafter the stitcher head 20 drives the staple through the group 12 of signatures.

A conventional clincher 30 disposed beneath the stitcher head 20 and the group 12 of collated signatures supports the signatures as the staple pierces the signatures. When the stitcher head 20 has driven the staple through the group 12 of signatures, the clincher 30 folds the ends of the staple to finish the stitching operation.

The stitcher head 20 and the clincher 30 reciprocate along a path parallel to the path of the conveyor 14. The stitching occurs when the speed of the head 20 and the clincher 30 matches the constant speed of the conveyor 14. The stitching operation thus is performed "on the fly".

At the upstream end of its stroke (to the right as viewed in FIG. 1) the stitcher head 20 and the clincher 30 are temporarily at rest. The stitcher head 20 and clincher 30 then accelerate in synchronism with the arrival of a group 12 of signatures. When the speed of the stitcher head 20 and the clincher 30 matches the speed of the group 12 of signatures, the clincher and stitcher head clamp the signature group, and stitching occurs. The stitcher head 20 and the clincher 30 may continue to accelerate, going faster than the conveyor 14 and pulling the group 12 of signatures ahead of the conveying chain. After the stitch is complete, the stitcher head 20 and the clincher 30 release the group 12 of signatures, and the conveyor 14 overtakes them. The stitcher head 20 and the clincher 30 then return upstream to their initial positions.

Figure 2:
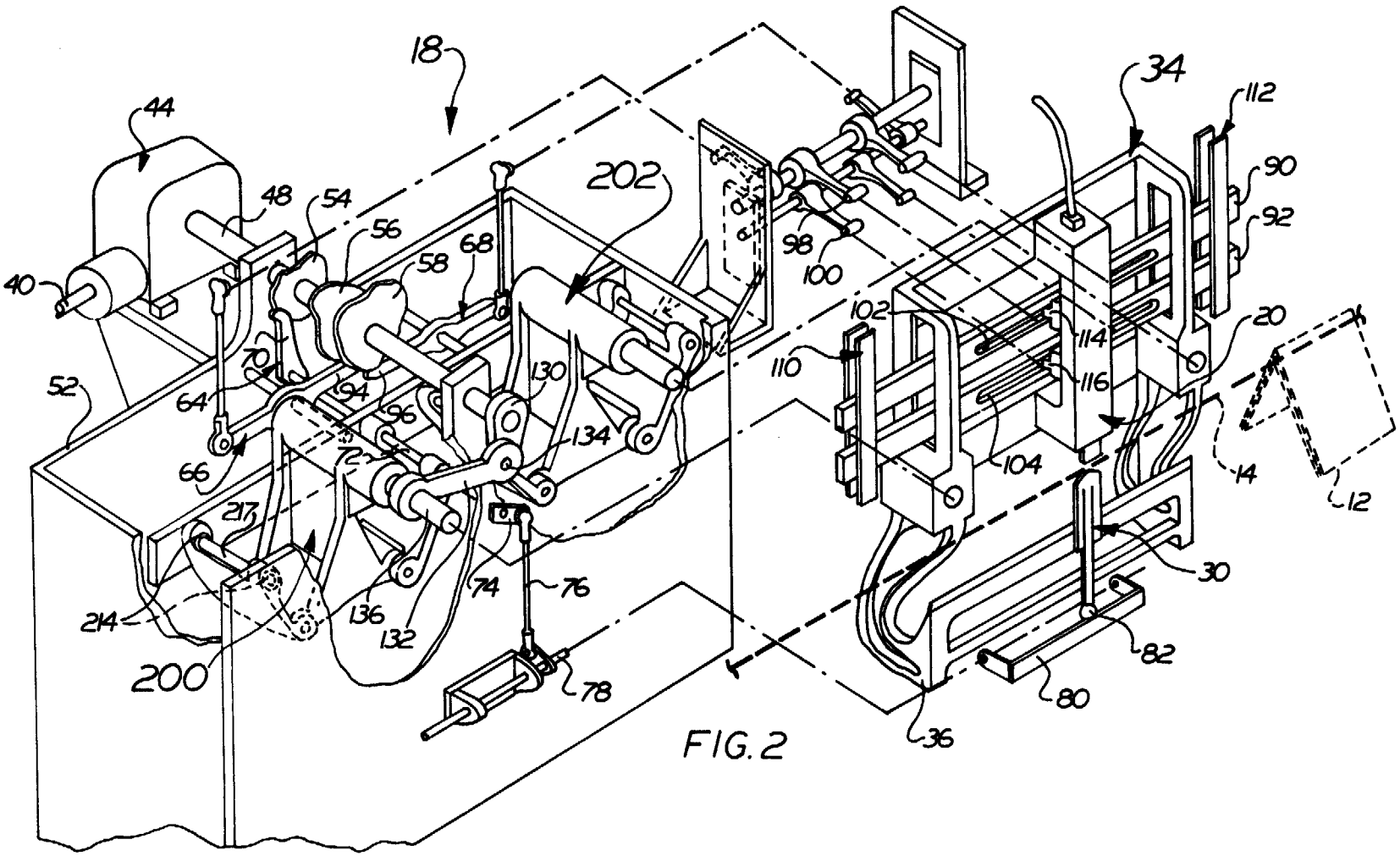
FIG. 2 is an exploded schematic illustration of a portion of the collating machine of FIG. 1 showing a frame on which the stitcher assembly is mounted, a crank and connecting rod for driving the frame in a reciprocating motion, and two suspension units for guiding the frame along a substantially straight line path.

FIG. 2 shows a broken-away, exploded view of the stitcher assembly 18 constructed in accordance with the present invention. The conventional stitcher head 20 is mounted to a reciprocating frame 34 for movement along the path of the conveyor 14. The frame 34 includes a downward, J-shaped extension 36 on which the clincher 30 is mounted. The conveyor 14 brings groups 12 of signatures over the hook of the J-shaped extension 36. Thus the group 12 of signatures pass between the stitching head 20 and the clincher 30.

The stitcher head 20 and the clincher 30 are driven in synchronism with the conveyor 14. A power input shaft 40 drives the conveyor 14 and the stitcher assembly 18. Power from the input shaft 40 is delivered to the stitcher assembly 18 through a worm and worm gear arrangement 44 to a drive shaft 48 which is mounted for rotation on the base 52 of the stitcher assembly 18. The drive shaft 48 carries cams 54, 56, and 58 which operate the stitcher head 20 and the clincher 30 through linkage assemblies 64, 66, and 68. The linkage assemblies drive the stitcher head 20 and the clincher 30 in synchronism with the operation of the conveyor 14 while the frame 34 carrying the stitcher head 20 and the clincher 30 reciprocates.

The linkage assembly 64 which drives the clincher 30 includes a cam follower 70 which is driven in a rocking motion by the cam 54 upon rotation of the drive shaft 48. The rocking motion of the cam follower 70 is transmitted through a shaft 72, a crank 74 and a link 76 which is eccentrically mounted to a shaft 78. The shaft 78 is rotatably supported by the base 52 of the stitcher assembly 18 and oscillates when the link 76 moves up and down. The shaft 78 carries a driver bar 80 which operates the clincher 30.

The driver bar 80 extends parallel to the path of motion of the frame 34, and a follower 82 connected with the clincher rides on the driver bar 80. Thus the linkage assembly 64 transmits the rocking motion of the cam follower 70 to the clincher head 30 to operate the clincher head in synchronism with the arrival of a group 12 of signatures while the frame 34 is reciprocating along the path of the conveyor 14.

In a similar fashion the linkages 66 and 68 transmit the motion induced by the cams 56 and 58 to horizontally extending driver bars 90 and 92. The oscillatory motion of cam followers 94 and 96 is transmitted through the linkage assemblies 66 and 68, respectively, to the rockers 98 and 100, respectively. The end portions of the rockers 98 and 100 are received in horizontally extending slots 102 and 104 in the driver bars 90 and 92, respectively. The driver bars 90 and 92 are free to move vertically but are constrained against horizontal motion by bar supports 110 and 112 at opposite ends of the driver bars.

The stitcher head 20 includes solid followers 114 and 116 which ride in the horizontally extending slots 102 and 104 in the driver bars 90 and 92 as the stitcher head 20 reciprocates. When the driver bars 90 and 92 move up and down in accord with the shapes of cams 56 and 58, the stitcher head 20 forms a staple and drives it through a group 12 of signatures. The result is that the linkage assemblies 66 and 68 transmit oscillatory motion from the cams 56 and 58 to the followers 114 and 116 of the stitcher head 20 while the stitcher head reciprocates.

Also connected with the drive shaft 48 is a crank 130 which is used to drive the frame 34 in a reciprocating motion. A connecting rod 132 has one end engaging the crank pin 134, and the other end engages the shaft 136 which is received in a cylindrical passage in the frame 34. When the drive shaft 48 rotates, the crank 130 drives the frame 34 through the connecting rod 132 in a reciprocating motion.

The frame 34 is connected with the base 52 of the stitcher assembly 18 by two suspension units 200 and 202. The suspension units 200 and 202 constrain the frame 34 to move in a substantially linear motion throughout the length of the stroke of the crank 130. The suspension units 202 and 204 do not require the use of any rails, ways, or other axially extending surfaces to guide the frame 34 in its substantially linear motion. Rather the suspension 202 and 204 include only joints in which there is rotational contact, and therefore all these joints may be easily manufactured and maintained. In addition, it is possible to provide automatic lubrication through a centralized system.

The suspension units 200 and 202 are substantially identical, and therefore only the suspension unit 200 will be described in detail. However, it is to be understood that the description of suspension unit 200 applies equally well to suspension unit 202.

Figure 3:
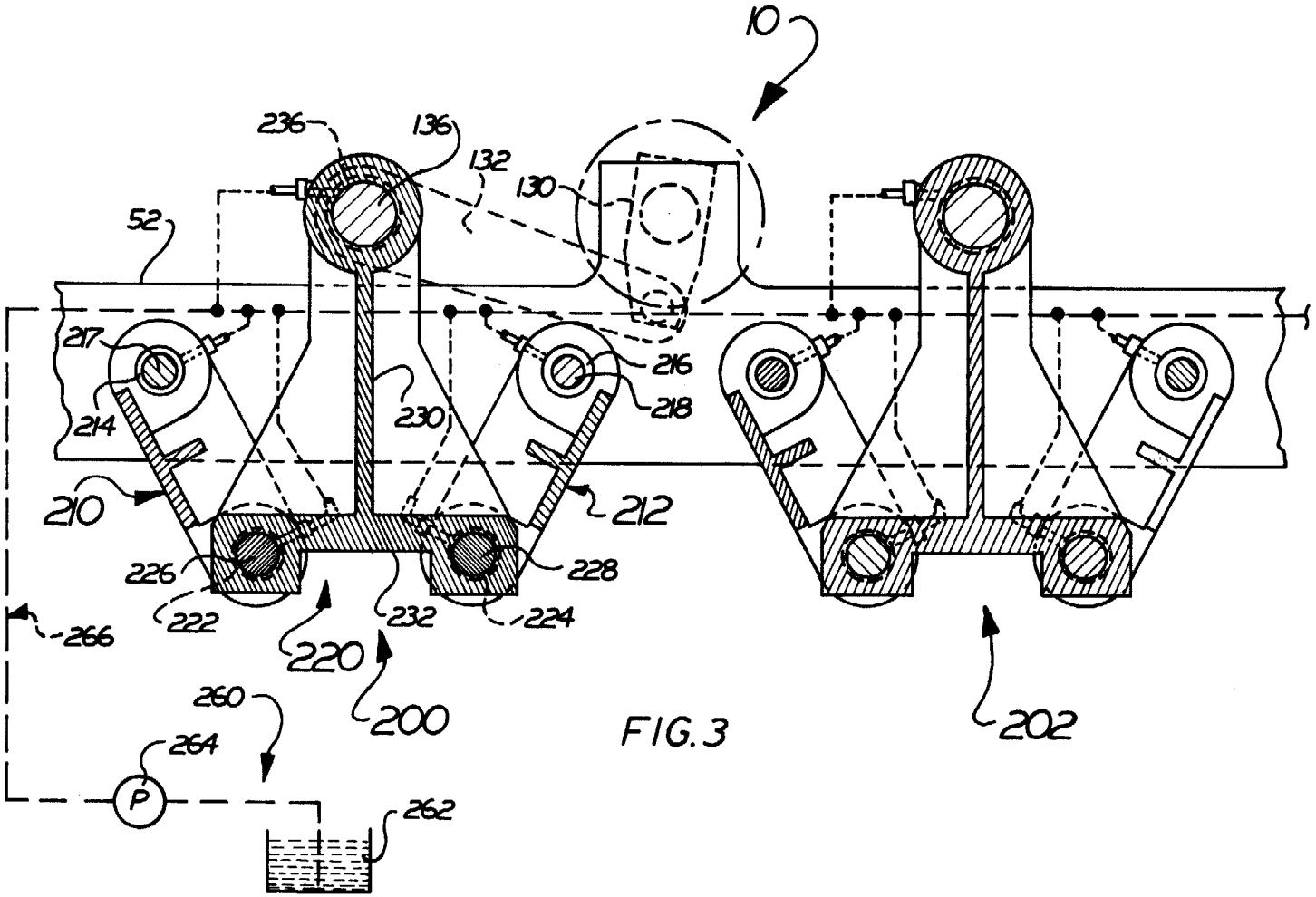
FIG. 3 is a sectional view of the suspension units of FIG. 2 also schematically showing conduits for conducting lubricant to connections in the suspension units.

The suspension unit 200 (FIG. 3) includes two suspension links 210 and 212. The upper end portion of each suspension link 210, 212 is pivotably connected with the stitcher assembly base 52 using conventional anti-friction bearings 214 and 216 through which extend shafts 217 and 218. The shafts 217 and 218 which connect the suspension 200 with the frame 52 of the stitcher assembly 18 and the similar shafts which connect the suspension unit 202 with the base of the stitcher assembly are mounted with their axes co-planer and parallel.

The lower ends of each suspension link 210 and 212 are connected with a coupler link 220 through the use of anti-friction bearings 222 and 224 and shafts 226 and 228. The coupler link 220 also includes a pedestal 230 which extends upward from the base 232 of the coupler link at a location midway between the shafts 226 and 228. An anti-friction bearing 236 located at the top of the pedestal receives the shaft 136 to which the reciprocating frame 34 and connecting rod 132 are connected.

Each suspension link 210, 212 and the coupler link 220 have been described as being essentially two dimensional. However, referring to FIG. 2, it is clear that each also extends axially. Thus the upper end portion of each suspension link 210 has two anti-friction bearings 214 which are axially spaced from each other along the length of shaft 217. Similarly, at the lower end portion of the suspension link 210 there are two bearings 222, and there are also two bearings 236 axially spaced from each other at the top of pedestal 230.

Figure 4:
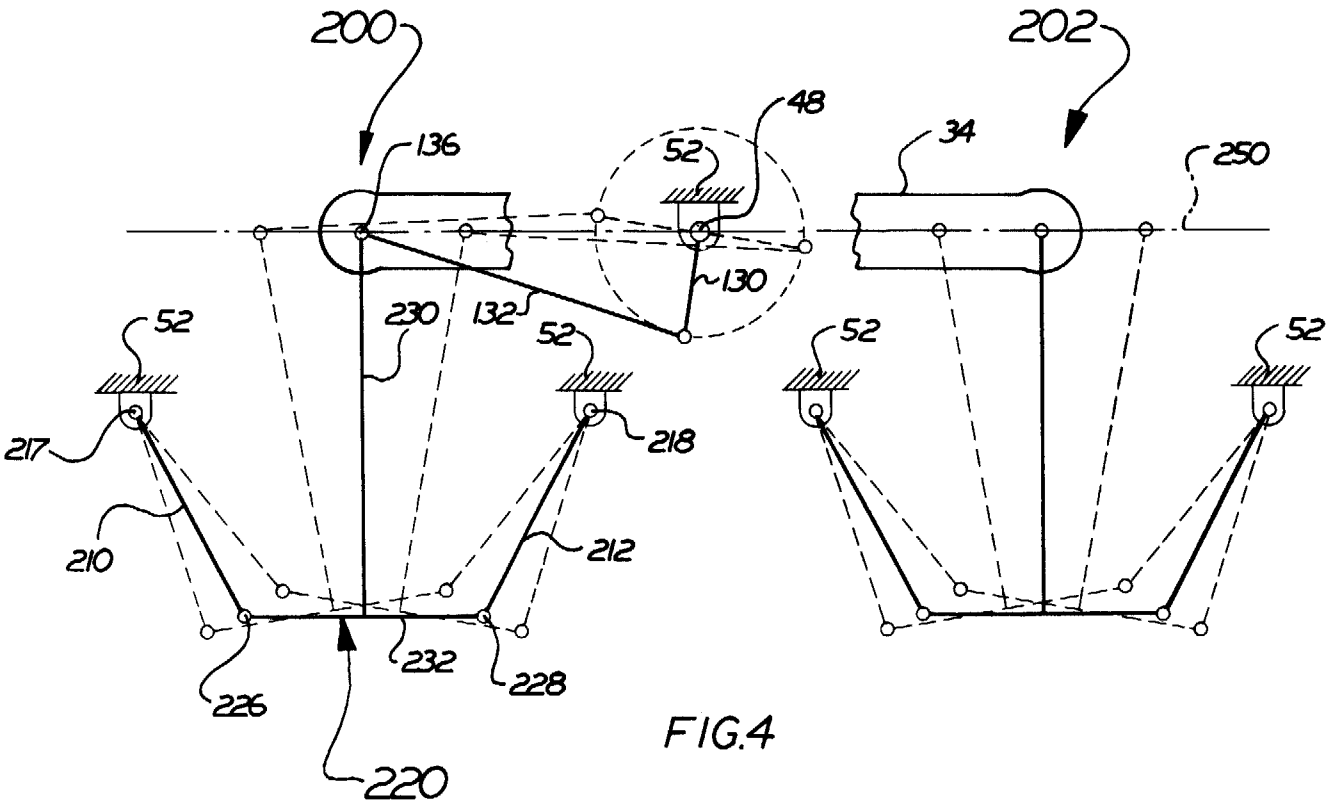
FIG. 4 is a schematic drawing of the suspension units of FIG. 3 illustrating the substantially straight line motion of the frame of FIG. 2 achieved through use of the suspension units.

The suspension units 200 and 202 (FIG. 4) guide the frame 34 along a substantially straight line path as indicated by the phantom line 250. As the shaft 48 rotates, the crank 130, and the connecting rod 132 drive the frame 34 in a reciprocating motion along a substantially straight line path indicated by the line 250. As the bases 232 of the coupler links 220 and 222 are caused to rock back and forth, the upper end portion of the pedestal 230 traces out a substantially straight line for the length of its stroke.

In a preferred embodiment, suspension links 210 and 212 extend six inches (6 in.) between the centers of shafts 217 and 226 and between the centers of shafts 218 and 228. The coupler link 220 is six and three eighths inches (6⅜ in.) from the center of shaft 226 to the center of shaft 228 and the center of shaft 136 is ten inches (10 in.) above a centerline connecting shafts 226 and 228. In this same preferred embodiment the shafts 217 and 218 which support the upper end portions of the links 210 and 212 are located twelve inches (12 in.) apart on the base 52 of the stitching machine 10 the crank 130 is proportioned to provide a total stroke of five and one-half inches (5½ in.) substantially along the path defined by the line 250. With this structure the center of the shaft 136 deviates from a straight line path by less than five thousandths of an inch (0.005 in.) over its entire stroke.

The stitcher assembly 18 constructed in accordance with the present invention is also equipped with an automatic lubrication system 260 (FIG. 3) which provides an automated supply of lubricant to the anti-friction bearings 214, 216, 222, 224, and 236 of the suspension unit 200 and to the corresponding bearings in the suspension unit 202. The automated lubricating system 260 includes a resevoir 262, a pump 264, and conduits which direct lubricant from the pump to the bearings. At least a portion of the conduits 266 may be made of a flexible material in order to accommodate the motion of the suspension units 200 and 202. The pump 264 may be controlled by any conventional timing unit to supply lubricant to the anti-friction bearings at appropriate intervals.

Although the present invention has been described as including only a single stitcher head 20 (FIG. 2) and a single clincher 30, the present invention also contemplates use of a plurality of stitcher heads and clinchers similar to the stitcher head 20 and the clincher 30 mounted on the same reciprocating frame 34.

The linkage assemblies 64, 66 and 68 which transmit oscillatory motion from the cams 54, 56, and 58 have been described as assemblies each having a fixed length. However, it is to be understood that the linkage assemblies are adjustable to accommodate various sizes and shapes of groups 12 of signatures. For instance the link 76 could be of adjustable length so that the uppermost position of the driver bar 80 could be varied to accommodate groups 12 of signatures having different thicknesses.

Thus it is clear that the present invention provides a new and improved stitcher assembly 18 in which a stitcher head 20 and a clincher 30 are mounted to a reciprocating frame 34 which in turn is guided for substantially linear motion by two suspension units 200 and 202. The suspension units 200 and 202 are mounted in tandem to the base 52 of the stitching machine 10. The suspension units 200 and 202 eliminate the guides or slides of conventional stitching machines, and thus overcome the difficulties inherent in those systems.

Each suspension unit 200 and 202 (FIG. 3) includes two suspension links 210 and 212 and a coupling link 220. The upper ends of the links 210 and 212 are pivotably connected with the stitcher machine base 52 and the lower ends are pivotably connected with opposite ends of the coupling link 220. The suspension links 210 and 212 support the coupling link 220 for rocking motion about a central position in which the coupling link is substantially horizontal.

Each coupling link includes an upstanding pedestal 230 to which the reciprocating frame 34 (FIG. 2) is connected. The pedestal 230 (FIG. 2) is fixedly connected with the base portion 232 of the coupling link and extends upward from it midway between the connections at opposite ends of the base of the link with the lower ends of the suspension rods 210 and 212. The upper end portion of the pedestal 230 includes an anti-friction bearing 236 which provides a rotatable connection with the reciprocating frame 34 (FIG. 2). It is a characteristic of the suspension units 200 and 202 that when the base 232 of the coupling link 220 rocks about its central position, the anti-friction bearing 236 at the upper end portion of the pedestal 230 traces out a substantially straight line path.

What is claimed is:

1. An apparatus comprising: a base, a reciprocatable frame connected with said base, a stitcher head and a clincher connected with said reciprocatable frame, means for operating said stitcher head and clincher to cause said stitcher head and clincher to bind the signatures in each group of an incoming stream of groups of collated signatures to each other, and first and second suspension units for said frame, each of said suspension units including two suspension links and a coupling link, the upper end portions of said suspension links being pivotally connected with said base at spaced apart locations, said coupling link of each suspension unit having opposite end portions pivotally connected with the lower end portions of said suspension links and having a pivotable connection with said reciprocatable frame whereby said reciprocatable frame is constrained to move in a substantially straight line with respect to said machine base.

2. An apparatus as set forth in claim 1 further including a drive shaft driven at a rate synchronized with the rate of arrival of the groups of signatures and a connecting rod having one end portion eccentrically connected with said drive shaft, a second end portion of said connecting rod being connected with said reciprocatable frame.

3. An apparatus as set forth in claim 1 wherein said pivotable connection between said coupling link and said reciprocatable frame is spaced from a line connecting said opposite end portions of said coupling link.

4. An apparatus as set forth in claim 3 wherein said pivotable connection between said coupling link and said reciprocatable frame and the line connecting said opposite end portions of said coupling link lie on opposite sides of a line connecting said upper end portions of said suspension links.

5. An apparatus as set forth in claim 4 wherein said suspension links are of equal length.

6. An apparatus as set forth in claim 5 wherein the distance between opposite end portions of said coupling link is larger than the length of said suspension links.

7. An apparatus as set forth in claim 2 wherein said means for operating said stitcher head and clincher includes cams fixedly connected with said drive shaft and cam followers in contact with surfaces of said cams and connected with said stitcher head.

8. An apparatus as set forth in claim 1 wherein said upper end portions of said two suspension links of said first suspension unit define a first plane, and said upper end portions of said two suspension links of said second suspension unit define a second plane, said first and second planes being parallel to each other.

9. An apparatus as set forth in claim 8 wherein said first and second planes are congruent.

10. An apparatus as set forth in claim 8 further including a drive shaft driven at a rate synchronized with the rate of arrival of the groups of signatures and a connecting rod having a first end portion eccentrically connected with said drive shaft, each of said two pivotable connections between said coupling links and said reciprocatable frame including a shaft extending parallel to said plane defined by said upper end portions of said suspension rods, said shafts extending between said coupling links and said reciprocatable frame, and a second end portion of said connecting rod being connected with one of said shafts, whereby said reciprocatable frame is driven in alternate opposite directions on a substantially straight line upon rotation of said drive shaft.

11. A collating machine comprising a collating station, a stitcher assembly and conveyor means for conveying groups of collated signatures from said collating station along a linear path through said stitcher assembly, said stitcher assembly including a reciprocatable frame, a stitcher head and a clincher connected with said frame, means for operating said stitcher head and clincher to cause said stitcher head and clincher to bind the signatures in each group of collated signatures to each other, first and second suspension units for said frame, each of said suspension units including two suspension links and a coupling link, the upper end portions of said suspension links being pivotally connected with a base of the stitcher assembly, said coupling link of each suspension unit having opposite end portions pivotally connected with the lower end portions of said suspension links and having a pivotable connection with said reciprocatable frame whereby said reciprocatable frame is constrained to move along a path substantially parallel to the linear path of said conveyor through said stitcher assembly.

12. An apparatus as set forth in claim 11 further including a drive shaft driven at a rate synchronized with the rate of arrival of the groups of signatures and a connecting rod having one end portion eccentrically connected with said drive shaft, a second end portion of said connecting rod being connected with said reciprocatable frame.

13. An apparatus as set forth in claim 11 wherein said pivotable connection between said coupling link and said reciprocatable frame and the line connecting said opposite end portions of said coupling link lie on opposite sides of a line connecting said upper end portions of said suspension links.

14. An apparatus as set forth in claim 13 wherein said suspension links are of equal length and the distance between opposite end portions of said coupling link is larger than the length of said suspension links.

15. An apparatus as set forth in claim 14 wherein said upper end portions of said two suspension links of said first suspension unit define a first plane, and said upper end portions of said two suspension links of said second suspension unit lie in said plane.

16. An apparatus as set forth in claim 11 further including conduit means for supplying lubricant to said first and second suspension units.

* * * * *